US007251978B2

(12) United States Patent
Seidel et al.

(10) Patent No.: US 7,251,978 B2
(45) Date of Patent: Aug. 7, 2007

(54) ROLL STAND FOR PRODUCING PLANE ROLL STRIPS HAVING A DESIRED STRIP PROFILE SUPERELEVATION

(75) Inventors: Jürgen Seidel, Kreuztal (DE); Wilfried Bald, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 164 days.

(21) Appl. No.: 10/466,668

(22) PCT Filed: Jan. 18, 2002

(86) PCT No.: PCT/EP02/00479

§ 371 (c)(1),
(2), (4) Date: Jul. 19, 2003

(87) PCT Pub. No.: WO02/058860

PCT Pub. Date: Aug. 1, 2002

(65) Prior Publication Data

US 2004/0040358 A1 Mar. 4, 2004

(30) Foreign Application Priority Data

Jan. 23, 2001 (DE) ..... 101 02 821

(51) Int. Cl.
*B21B 31/07* (2006.01)
*B21B 29/00* (2006.01)
*B21B 39/20* (2006.01)

(52) U.S. Cl. ..... 72/247; 72/243.2; 72/252.5; 72/241.8

(58) Field of Classification Search ..... 72/243.2, 72/243.4, 252.5, 245, 241.2, 249, 241.4, 72/241.6, 241.8, 242.2, 242.4, 243.6, 247
See application file for complete search history.

(56) References Cited

U.S. PATENT DOCUMENTS

| | | | | |
|---|---|---|---|---|
| 1,744,017 | A * | 1/1930 | Steckel | 72/241.2 |
| 2,139,872 | A | 12/1938 | Worthington | |
| 3,648,496 | A * | 3/1972 | Petry et al. | 72/11.8 |
| 3,857,268 | A * | 12/1974 | Kajiwaka | 72/247 |
| 4,184,353 | A * | 1/1980 | Sebardt et al. | 72/221 |

(Continued)

FOREIGN PATENT DOCUMENTS

| | | |
|---|---|---|
| DE | 3219554 | 12/1982 |
| DE | 3401894 | 7/1985 |
| DE | 3712043 | 10/1988 |

(Continued)

*Primary Examiner*—Dmitry Suhol
(74) *Attorney, Agent, or Firm*—Friedrich Kueffner

(57) ABSTRACT

The aim of the invention is to improve known roll stands (10) which are characterized by working rolls (1,2) of various diameters, in such a way that a strip is obtained which is largely free of tensions and undulations, has a desired strip profile superelevation, and can be used approximately universally. To this end, the support rolls (3,4) and the working rolls (1,2) are arranged in an axially displaceable manner in the roll stand (10,11), the position of at least one of the working rolls (1,2) can be adjusted in the discharge direction (7) of the roll strip (6), and that the support rolls (3,4) and the working rolls (1,2) are provided with a curved contour (continuously variable crown which is determined by an at least second order polynomial) which extends essentially over the whole surface length of the roll, said contours being staggered by 180° in relation to each other and respectively embodied in such a way that both contours of the working rolls (1,2) complete each other to form a symmetrical contour of the roll gap.

9 Claims, 1 Drawing Sheet

U.S. PATENT DOCUMENTS

| | | | | | |
|---|---|---|---|---|---|
| 4,194,382 | A | * | 3/1980 | Kajiwara | 72/241.8 |
| 4,577,480 | A | * | 3/1986 | Kizaki et al. | 72/10.5 |
| 4,800,742 | A | | 1/1989 | Feldmann et al. | |
| 4,881,396 | A | * | 11/1989 | Seidel et al. | 72/247 |
| 5,560,237 | A | * | 10/1996 | Yasuda et al. | 72/13.4 |

FOREIGN PATENT DOCUMENTS

| | | | | |
|---|---|---|---|---|
| EP | 1033182 | | | 9/2000 |
| GB | 2100472 | A | * | 12/1982 |
| JP | 59087911 | A | * | 5/1984 |
| JP | 61235007 | A | * | 10/1986 |

* cited by examiner

ROLL STAND FOR PRODUCING PLANE ROLL STRIPS HAVING A DESIRED STRIP PROFILE SUPERELEVATION

The invention concerns a rolling mill for producing plane rolled strips having a desired strip profile superelevation, with work rolls supported on at least one backup roll, such that the work rolls have different diameters, and the thicker work roll is connected with a drive, while the thinner work roll follows as an idle roll.

Rolling mills using work rolls with different diameters are well known. For example, U.S. Pat. No. 2,139,872 describes a rolling mill in which, to achieve the most effective possible reduction in the rolled strip during rolling, there are two work rolls with different diameters supported on backup rolls. In this regard, it was found to be advantageous to drive only the larger work roll and to let the smaller work roll follow as an idle roll. Previously known rolling mills of this type are advantageously used in the rear stands of a rolling train with the goal of reducing the rolling force and the driving power and achieving a smaller edge drop, especially in the case of high-carbon steel.

In the hot rolling of strip material, the thermal crown and the wear of the work rolls and their elastic deformations are subject to relatively large variations within a rolling program. Without correction by final control elements, the strip contour changes with increasing throughput of rolled material. This effect varies from stand to stand and from pass to pass. Accordingly, variations occur not only in the strip contour, but also in the predetermined hot strip flatness and eventually in the cold strip flatness.

The object of the invention is to further modify the well-known rolling mill with its different work roll diameters in such a way that a strip of high quality is produced, and these stands can be universally used.

This object is achieved in a rolling mill of the specified type by the characterizing features of claim 1 in such a way that:

- the backup rolls and the work rolls are arranged in the rolling stand in such a way that they can be axially displaced,
- at least one of the work rolls can be adjusted in the discharge direction of the rolled strip, and
- the backup rolls and the work rolls are provided with a curved contour over essentially the entire length of the body (CVC grind (continuously variable crown), which is determined by a polynomial of at least second order), such that these contours are staggered by 180° relative to each other and are each designed in such a way that the two body contours of the work rolls complement each other to form a symmetrical contour of the roll gap.

As a result of the combination, in accordance with the invention, of providing the well-known, different-sized work rolls with a CVC grind (described, for example, in DE 37 120 43 C2; in this connection, the CVC grind or the roll contour obeys a polynomial of second or higher order) and of arranging the work rolls and backup rolls in such a way that they can be displaced both axially and in the discharge direction, a totally new rolling stand concept is obtained, which, in contrast to the previously known rolling stands, can be universally used and produces the rolled strips with a high degree of flatness and the desired strip profile superelevation.

With these rolling stands, it is advantageous to calculate and exceute the grind by a polynomial of the third or higher order, including, for example, the fifth order, as the profile final control element for the CVC grind of the work rolls. For example, a fifth-order polynomial of general form:

$$R(x)=a_5 \cdot x^5+a_4 \cdot x^4+a_3 \cdot x^3+a_2 \cdot x^2+a_1 \cdot x+a_0$$

would then have the following parameters, e.g., for a roll 1,900 mm long, specifically, for a coordinate system R(x) on the edge of the roll:

$a_0=0.349712 \cdot 10^3$ mm (radius of the work roll)

$a_1=0.733199 \cdot 10^{-3}$ $a_2=0.198038 \cdot 10^{-3}$ mm$^{-1}$ $a_3=-0.536180 \cdot 10^{-3}$ mm$^{-2}$ $a_4=0.368442 \cdot 10^{-11}$ mm$^{-3}$ $a_5=-0.775668 \cdot 10^{-15}$ mm$^{-4}$ for a coordinate system R(x) in the center of the roll:

$a_0=0.350000 \cdot 10^3$ mm (radius of the work roll)

$a_1=-0.544375 \cdot 10^{-3}$ $a_2=0.000000 \cdot$ mm$^{-1}$ $a_3=0.163860 \cdot 10^{-8}$ mm$^{-2}$ $a_4=-0.590250 \cdot 10^{-28}$ mm$^{-3}$ $a_5=-0.775668 \cdot 10^{-15}$ mm$^{-4}$ Since the work rolls have different diameters, they also show different deflection and flattening behavior. Particularly the effects between the backup rolls and the work rolls are different. This is especially the case for a three-high rolling stand, in which only the thinner work roll is supported by a backup roll, since the thicker work roll has no support at all. Therefore, in accordance with the invention, the contours of the work rolls are designed differently in order to compensate these effects. In this regard, the calculation of the necessary contour is done offline with the goal of producing a roll gap that is symmetrical under load.

The new rolling stand concept is especially applicable to a three-high rolling stand of this type. These stands can then also be advantageously used for the front stands, for example, for loads that are not too high. In this three-high rolling stand as well, only the thicker work roll is driven, and the thinner work roll follows as an idle roll. The thicker work roll acts as the work roll, which can transmit a high torque and at the same time serves as a backup roll. The combination with the other, thinner work roll, which is supported by a separate backup roll, then results in controllable rolling forces.

Since strip turn-up (bending up of the forward edges of the strip) can be expected as a result of the given boundary conditions with the use of work rolls with different diameters, especially in the case of the rolling of thick strip, in accordance with the invention, one of the work rolls is arranged in such a way that it can be displaced in the discharge direction for the purpose of preventing this turn-up of the strip. The adjustment of this roll displacement is controlled, among other ways, as a function of the run-in and runout thickness, the material strength of the rolled strip, the actual diameter combination of the work rolls, etc.

In the case of a rolling stand that contains a nondriven smaller work roll and is not pretensioned (before the initial pass, the roll gap corresponds approximately to the strip run-in thickness), it is advantageous for the nondriven work roll also to be provided with an auxiliary drive, which can then be disconnected and/or shut off after the initial pass. The vibrations that frequently occur in the forward stands during rolling (the work rolls swinging against each other) are prevented by this measure, since then the work rolls are decoupled with respect to the drive. In addition, the auxiliary drive advantageously also allows a possibly necessary axial displacement of the work rolls during rolling pauses.

In order to compensate the boundary conditions resulting from the different work roll diameters, it is also possible, in accordance with the invention, to adjust different work roll bending forces for each of the work rolls and for each of their sides as a function of the sliding position of each of the rolls. Furthermore, to counter the higher surface pressing between the thin work roll with its backup roll, these rolls can be suitably lengthened.

In order to counter the different wear of the work rolls due to their different diameters, the work rolls are produced from materials with different wear behavior or from highly wear-resistant materials, for example, by a powder metallurgical process, preferably the HIP process (hot isostatic pressing). As is described in the offprint from "Stahl" (1998), No. 6, pp. 38–40, in the HIP process, the material to be treated is heated above its yield point in special autoclaves (HIP systems) at high temperature (up to 2,000° C., depending on the material) and with pressure applied from all directions (up to 200 MPa) and simultaneously compacted.

Further details of the invention are explained in greater detail below with reference to specific embodiments illustrated in the drawings.

Figure 1:
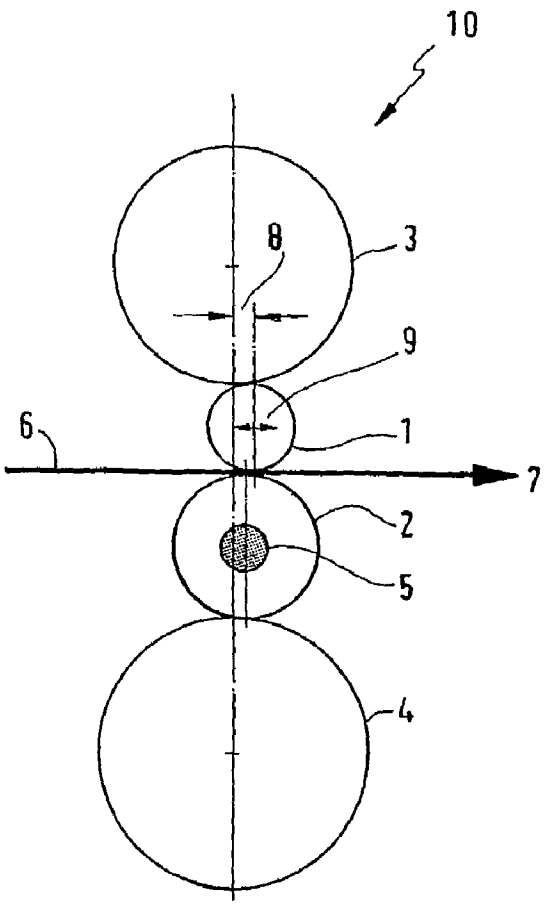
FIG. 1 shows a four-high stand in a schematic side view.

FIG. 1 shows a four-high stand 10 with two work rolls 1, 2, which are supported on backup rolls 3, 4. A work roll 2 with a larger diameter is located below the rolled strip 6, and a work roll 1 with a smaller diameter is located above the rolled strip 6. The larger work roll 2 is provided with a drive 5, while the thinner work roll 1 has no drive and merely follows as an "idle roll" by contact with the rolled strip 6. The thinner work roll 1 is arranged in such a way that it can be moved horizontally in the arrow direction 9. In the embodiment shown here, it is displaced from its original position by the amount 8 in the discharge direction 7.

In accordance with the invention, the contours of the surfaces of the work rolls 1, 2 with their assigned backup rolls 3, 4 are produced by a CVC grind, which is calculated by a polynomial of at least second order (in the side view of the rolling stand 10 shown in the drawing, this CVC grind is not visible). For example, the upper work roll 1 may have a diameter of 400 mm, the lower work roll 2 a diameter of 600 mm, and each of the backup rolls 3, 4 a diameter of 1,350 mm.

Figure 2:
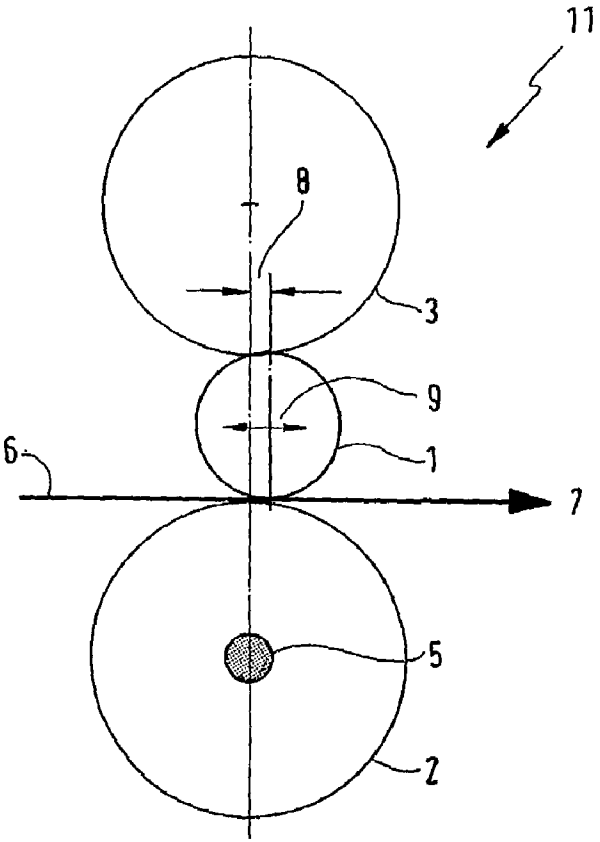
FIG. 2 shows a three-high stand in a schematic side view.

FIG. 2 shows a three-high rolling stand 11, in which only the upper, thinner work roll 1 is supported on a backup roll 3. The thicker, driven work roll 2, on the other hand, is selected sufficiently large in its diameter that higher torques can be transmitted, and therefore this work roll simultaneously serves as a backup roll. In this example of FIG. 2, the thinner work roll 1 is also displaced from its original position by the amount 8 in the discharge direction 7. The upper work roll in this case may have a diameter of, e.g., 600 mm, and the upper backup roll 3 a diameter of 1,400–1,600 mm. The diameter of the lower work roll 2, which is simultaneously used as a backup roll, may be, e.g., 1,400 mm.

The examples illustrated in FIGS. 1 and 2 show the application of the invention in two rolling stands. Naturally, the invention may also be applied to other rolling stands with different numbers of rolls from the examples, for example, in rolling stands with intermediate rolls.

LIST OF REFERENCE NUMBERS

1 work roll
2 work roll
3 backup roll
4 backup roll
5 work roll drive
6 rolled material
7 discharge direction
8 roll displacement
9 displacement direction
10 4-high rolling stand
11 3-high rolling stand

The invention claimed is:

1. Rolling mill for producing plane rolled strips (6) having a desired strip profile superelevation, with work rolls (1, 2) supported on at least one backup roll (3, 4), such that the work rolls (1, 2) have different diameters, and the thicker work roll (2) is connected with a drive (5), while the thinner work roll (1) follows as an "idle roll," wherein the backup rolls (3, 4) and the work rolls (1, 2) are arranged in the rolling stand (10, 11) in such a way that they can be axially displaced, at least one of the work rolls (1, 2) can be adjusted in the discharge direction (7) of the rolled strip (6), and the backup rolls (3, 4) and the work rolls (1, 2) are provided with a curved contour over essentially the entire length of the body (CVC grind (continuously variable crown), which is determined by a polynomial of at least second order), such that these contours are staggered by 180° relative to each other and are each configured so that the two body contours of the work rolls (1, 2) complement each other to form a symmetrical contour of the roll gap, wherein the backup rolls are lengthened relative to the work rolls, and wherein different work roll bending forces can be adjusted for each of the work rolls (1, 2) and for each of their sides as a function of their sliding position.

2. Rolling mill in accordance with claim 1, wherein, to compensate for different deflection and flattening behavior, the work rolls (1, 2) are designed with different contours from each other (different CVC grind), such that a polynomial of third or higher order is used to calculate the contours.

3. Rolling mill in accordance with claim 2, wherein a fifth-order polynomial is used to calculate the contours.

4. Rolling mill (10, 11) in accordance with claim 1, wherein the roll displacement (8) of the at least one of the work rolls (1, 2) can be continuously adjusted in the discharge direction (7).

5. Rolling mill (10, 11) in accordance with claim 4, wherein the magnitude of the roll displacement (8) is controlled as a function of the run-in and runout thickness of the rolled strip (6), its material strength, and the actual diameter combination of the work rolls (1, 2).

6. Rolling mill (10, 11) in accordance with claim 1, wherein only the thinner work roll (1) is supported by a backup roll (3).

7. Rolling mill (10, 11) in accordance with claim 1, wherein the work rolls (1, 2) are produced from materials with different wear behavior and/or from highly wear-resistant materials produced by a powder metallurgical process.

8. Rolling mill (10, 11) in accordance with claim 7, wherein the work rolls are produced from highly wear-resistant materials produced by the HIP process (hot isostatic pressing).

9. Rolling mill in accordance with claim 1, wherein the thinner work roll (1) is connected with an auxiliary drive that can be at least one of shut off and disconnected.

* * * * *